US010138057B2

(12) United States Patent
Luo

(10) Patent No.: US 10,138,057 B2
(45) Date of Patent: Nov. 27, 2018

(54) GARBAGE CAN LID HAVING GARBAGE COMPRESSING MECHANISM AND GARBAGE CAN INCLUDING THE SAME

(71) Applicant: Michael Shek, San Mateo, CA (US)

(72) Inventor: Zhiyue Luo, Ningbo (CN)

(73) Assignee: Michael Shek, San Mateo, CA (US)

( * ) Notice: Subject to any disclaimer, the term of this patent is extended or adjusted under 35 U.S.C. 154(b) by 1090 days.

(21) Appl. No.: 14/506,609

(22) Filed: Oct. 4, 2014

(65) Prior Publication Data

US 2015/0151909 A1 Jun. 4, 2015

(30) Foreign Application Priority Data

Dec. 4, 2013 (CN) ..... 2013 1 0687017

(51) Int. Cl.

| | |
|---|---|
| ***B65F 1/14*** | (2006.01) |
| ***B30B 9/30*** | (2006.01) |
| ***B65F 1/16*** | (2006.01) |
| ***B65D 43/18*** | (2006.01) |

(52) U.S. Cl.

CPC ..... *B65F 1/1405* (2013.01); *B30B 9/3053* (2013.01); *B65D 43/18* (2013.01); *B65F 1/1623* (2013.01); *B65F 1/1638* (2013.01)

(58) Field of Classification Search

CPC .... B65F 1/1405; B65F 1/1623; B65F 1/1638; B65D 43/18; B30B 9/3053

USPC ..... 100/255

See application file for complete search history.

(56) References Cited

U.S. PATENT DOCUMENTS

| | | | | | |
|---|---|---|---|---|---|
| 2,465,839 | A * | 3/1949 | Bloomfield | B65F 1/1405 | 100/226 |
| 3,565,351 | A * | 2/1971 | Ross, Jr. | B02C 19/0081 | 100/240 |
| 3,602,136 | A * | 8/1971 | Ligh | B30B 9/3039 | 100/126 |
| 3,760,718 | A * | 9/1973 | Adornetto | B30B 9/3053 | 100/227 |
| 3,779,157 | A * | 12/1973 | Ross, Jr. | B30B 9/3053 | 100/240 |
| 3,946,662 | A * | 3/1976 | Ross, Jr. | B65F 1/1405 | 100/240 |
| 3,955,492 | A * | 5/1976 | Topolay | B30B 9/3014 | 100/215 |
| 4,080,889 | A * | 3/1978 | Shiloni | B30B 9/3032 | 100/219 |
| 4,128,055 | A * | 12/1978 | Hellmann | B30B 9/3053 | 100/245 |

(Continued)

*Primary Examiner* — Sean Michalski

(74) *Attorney, Agent, or Firm* — Muncy, Geissler, Olds & Lowe, P.C.

(57) ABSTRACT

A garbage can lid having garbage compressing mechanism includes a main body, a pivoting lid, a top lid, a pressing pad, and a pressing rod. The pivoting lid is pivotally arranged above the opening of the main body. The pivoting lid is formed with a receiving room, and a through hole is formed on a bottom of the receiving room. The top lid selectively covers the receiving room. The pressing pad is arranged below the pivoting lid and is connected with the pivoting lid via a restoring element. The pressing rod is able to be folded to be received in the receiving room. The pressing rod is able to be straight to push the pressing pad through the through hole in order to compress garbage. Thus, garbage can be compressed without opening the garbage can lid.

10 Claims, 8 Drawing Sheets

(56) References Cited

U.S. PATENT DOCUMENTS 4,212,240 A * 7/1980 Lee ..... B30B 9/3032 100/218
4,232,599 A * 11/1980 Ulrich ..... B30B 9/3014 100/218
4,554,868 A * 11/1985 Zimmer ..... B30B 9/30 100/229 R
4,658,720 A * 4/1987 Massonnet ..... B65F 1/1405 100/226
5,090,309 A * 2/1992 Lai ..... B30B 9/3053 100/226
6,314,874 B1 * 11/2001 Martorella ..... B65F 1/1405 100/226
6,889,604 B2 * 5/2005 Ernst ..... B65F 1/02 100/226
7,150,422 B2 * 12/2006 Wang ..... B02C 18/0007 241/100
7,237,480 B2 * 7/2007 Ruddock ..... B30B 9/3053 100/226
7,395,757 B1 * 7/2008 Baghdoian ..... B30B 9/3053 100/226
9,517,881 B2 * 12/2016 Scherer ..... B65F 1/02
2003/0233949 A1 * 12/2003 Ko ..... B30B 9/3032 100/214
2003/0233950 A1 * 12/2003 Ko ..... B30B 9/3032 100/214
2007/0071914 A1 * 3/2007 De Winter ..... B30B 9/3053 428/2
2008/0257176 A1 * 10/2008 Chiu ..... B30B 9/3021 100/221
2010/0181313 A1 * 7/2010 Turina ..... B65F 1/1405 220/212
2011/0203464 A1 * 8/2011 Johannesen, Jr. ..... B65F 1/1405 100/56
2012/0118179 A1 * 5/2012 Creighton ..... B30B 9/3032 100/100
2013/0036924 A1 * 2/2013 Ko ..... B30B 9/3053 100/214
2013/0037547 A1 * 2/2013 Ko ..... B65F 1/08 220/495.08
2013/0087055 A1 * 4/2013 Kim, II ..... B65F 1/06 100/240
2013/0206021 A1 * 8/2013 Prescott ..... B30B 9/3053 100/35
2013/0299494 A1 * 11/2013 Ellman ..... B65F 1/08 220/263
2015/0075393 A1 * 3/2015 Ho ..... B65F 1/1405 100/245
2015/0360863 A1 * 12/2015 Meza ..... B65F 1/1405 220/254.3
2017/0259995 A1 * 9/2017 Russo ..... B65F 1/1405
2017/0362026 A1 * 12/2017 McIntosh ..... B65F 1/1405
2018/0022543 A1 * 1/2018 Jokinen ..... B65F 1/1405
2018/0037407 A1 * 2/2018 Hyytinen ..... B65F 1/1405

* cited by examiner

GARBAGE CAN LID HAVING GARBAGE COMPRESSING MECHANISM AND GARBAGE CAN INCLUDING THE SAME

BACKGROUND OF THE INVENTION

Field of the Invention

The present invention relates to a garbage can lid having garbage compressing mechanism and a garbage can including the garbage can lid.

Description of the Prior Art

A conventional garbage can receive only a predetermined amount of garbage when the garbage is not compressed. To release more space for receiving garbage, the garbage has to be compressed. Generally, a user has to open the garbage can lid to compress the garbage. However, it is unsanitary that odor or fluid of garbage comes out during compressing the garbage.

Some garbage cans with garbage compressing mechanism are available now. Patent TW M319919 showed a garbage can lid having a pressing rod above and an elastic rope associating the lid and the garbage can near the opening thereof. The pressing rod can be held for push the lid downward to compress the garbage with the lid. However, the interior of the garbage can still communicates with exterior during compressing the garbage, so the problem mentioned above is still not solved. Besides, the pressing rod occupies too much space.

A more wide-spreading structure is disclosed in patents TW 341951, TW

M341010, TW M377412, TW M394316, TW M319919, TW M401645, TW M429687, and TW M445004. A pressing rod passes through a hole of the lid to connect with a pressing pad below the lid. When the pressing rod is pushed downward, the pressing pad is moved downward to compress the garbage. However, the pressing rod is still exposed to occupy too much space in a normal state.

Patents TW M365344 and TW M437840 further disclosed a pressing rod which is detachably. However, the detached pressing rod is usually placed beside the garbage can to be quite unsanitary, and the detached pressing rod may be missed.

SUMMARY OF THE INVENTION

The main object of the present invention is to provide a garbage can lid having garbage compressing mechanism and a garbage can including the garbage can lid.

To achieve the above and other objects, a garbage can lid of the present invention includes a main body, a pivoting lid, a top lid, a pressing pad, a restoring element, and a pressing rod.

The main body is adapted for being disposed on a can above a can opening of the can. The main body is formed with an opening The pivoting lid is pivotally disposed on the main body to selectively close the opening The pivoting lid is formed with a through hole. The pressing pad is arranged below the pivoting lid. A face of the pressing pad faces the pivoting lid having a connecting portion which positionally corresponds to the through hole. The restoring element associates the pivoting lid and the pressing pad so that the pressing pad tends to move toward the pivoting lid.

A top of the pivoting lid is recessedly formed with a receiving room. The through hole is formed on a bottom of the receiving room. The top lid is disposed on the pivoting lid to selectively cover the receiving room. The pressing rod includes four rod segments which are pivotally linked one by one so that the pressing rod is foldable to be received in the receiving room. A restriction structure is arranged between any two adjacent rod segments. The restriction structure includes a restriction notch and a restriction protrusion which has an inclined top face. The restriction notch is formed on one of the two adjacent rod segments, and the restriction protrusion is formed on an outer surface of the other one of the two adjacent rod segments. When the two adjacent rod segments are aligned, the restriction protrusion covered by its adjacent rod segment, and the restriction notch are staggered from each other. When the two adjacent rod segments are substantially perpendicular to each other, the restriction protrusion is received in the restriction notch to prohibit the two adjacent rod segments from pivoting with respect to each other. The pressing element is pivotally disposed on a free end of the most distal rod segment. The restriction structures allow the four rod segments pivot to form a rectangular frame. The rectangular fame is able to be received in the receiving room.

A garbage can including the garbage can lid is also provided. The garbage can further includes a can. The main body is arranged above a can opening of the can. The pressing rod is able to push the pressing pad downward into an interior of the can.

Thus, when the pressing rod is utilized to push the pressing pad for compressing garbage, the garbage can lid is kept from being opened so that odor of garbage may not come out. Besides, the pressing rod can be folded to be stored in the garbage can lid.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1A:
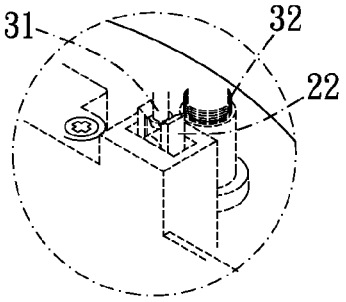
FIG. 1A is a partial enlargement of FIG. 1.

Please refer to FIG. 1 to FIG. 10, the garbage can lid having garbage compressing mechanism of the present invention includes a main body 10, a pivoting lid 20, a top lid 30, a pressing pad 40, a restoring element 50, and a pressing rod 60.

The main body 10 is adapted for being disposed around a can opening of a can 70. The main body 10 is formed with an opening The pivoting lid 20 is pivotally disposed on the main body 10 to selectively close the opening The pivoting lid 20 is recessedly formed with a receiving room 21 from a top thereof. A through hole 211 is formed on a bottom of the receiving room 21. In the present embodiment, the main body 10 is arranged with a switch 11 and a sensor 12 thereon wherein the switch 11 and the sensor 12 are electrically connected with a pivoting structure between the main body 10 and the pivoting lid 20 respectively. Thereby, the pivoting lid 20 is controlled to pivot with respect to the main body 10 for opening by pressing the switch 11 or triggering the sensor 12.

The top lid 30 is selectively covers the opening of the receiving room 21. As shown in FIG. 1A, in the present embodiment, the top lid 30 is pivotally disposed around the opening of the receiving room 21 so as to pivot with respect to the opening of the receiving room 21. A spring 32 is disposed between the top lid 30 and the pivoting lid 20. A clipping element 22 facing the top lid 30 is disposed in the receiving room 21, and the top lid 30 has a positioning pin 31 facing the pivoting lid 20. When the top lid 30 is pressed toward the receiving room 21, the positioning pin 31 is clamped by the clipping element 22 so that the top lid 30 is positioned to the pivoting lid 20. When the top lid 30 is pressed downward again, the positioning pin 31 is released from the clipping element 22 so that the top lid 30 is pivotable again.

The pressing pad 40 is arranged below the pivoting lid 20. The pressing pad 40 has a connecting portion 41 at a position corresponding to the through hole 211 on a face thereof facing the pivoting lid 20. The restoring element 50 associates the pivoting lid 20 and the pressing pad 40 so that the pressing pad 40 tends to move toward the pivoting lid 20. Preferably, the restoring element 50 is an elastic rope or elastic wire. More specifically, the connecting portion 41 of the pressing pad 40 is rectangular column-shaped to form a guiding hole 411 which is tube-shaped. The guiding hole 411 is formed with a guiding groove 412 on an inner wall thereof wherein the guiding groove 412 extends axially. The guiding groove 412 positionally corresponds to one corner of the connecting portion 41. The through hole 211 of the pivoting lid 20 is tube-shaped and has a rectangular cross-section. The connecting portion 41 is able to be slidably received in the through hole 211.

The pressing rod 60 includes four rod segments 61 and a pressing element 62 wherein the rod segment 61 are pivotally linked one by one. A restriction structure is arranged between any two adjacent rod segments 61. The restriction structure includes a restriction notch 611 and a restriction protrusion 612 which has an inclined top face. The restriction notch 611 is formed on one of the two adjacent rod segments 61, and the restriction protrusion 612 is formed on an outer surface of the other one of the two adjacent rod segments 61. When the two adjacent rod segments 61 are aligned, the restriction protrusion 612 is covered by its adjacent rod segment 61, and the restriction notch 611 and the restriction protrusion 612 are staggered from each other. When the two adjacent rod segments 61 are substantially perpendicular to each other, the restriction protrusion 612 is received in the restriction notch 611 to prohibit the two adjacent rod segments 61 from pivoting with respect to each other. The pressing element 62 is pivotally disposed on a free end of the most distal rod segment 61. The restriction structures allow the four rod segments 61 pivot to form a rectangular frame. The rectangular fame is able to be received in the receiving room 21. The pressing rod 60 further has an engaging portion 613 at an end thereof away from the pressing element 62. The engaging portion 613 is able to be inserted through the through hole 211 of the pivoting lid 20 to be detachably engaged with the connecting portion 41 of the pressing pad 40 so as to push the pressing pad 40 downward.

More specifically, the engaging portion 613 of the pressing rod 60 is substantially cylinder-shaped. The engaging portion 613 is formed with a sliding piece 6131 on an outer surface thereof. Each rod segment 61 is substantially rectangular column-shaped to correspond to the through hole 211. When the engaging portion 613 is inserted into the guiding hole 411, the sliding piece 6131 is slidably received in the guiding groove 412. The sliding piece 6131 positionally corresponds to one side face of the rod segment 61. The top face of each restriction protrusion 612 is rectangular and has an edge connected with an outer surface of the rod segment 61. The restriction protrusion 612 has three lateral faces including two triangular lateral faces and a rectangular lateral face. Another restriction structure is arranged between the pressing element 62 and the rod segment 61 which is connected with the pressing element 62. The pressing element 62 is pivotable around a first pivot axis with respect to the rod segment 61 which is connected to the pressing element 62 Any two adjacent rod segments 61 are pivotable with respect to each other around a pivot axis perpendicular to the first pivot axis.

When the rod segments 61 and the pressing element 62 are aligned, the pressing element 62 has a face perpendicular to the rod segments 61 for being pressed downward. When the rod segments 61 are folded to be a rectangular frame with the pressing element 62 also folded with respect to the rod segment 61, the face of the pressing element 62 is parallel to the rectangular frame and is located above the rectangular frame.

Figure 6A:
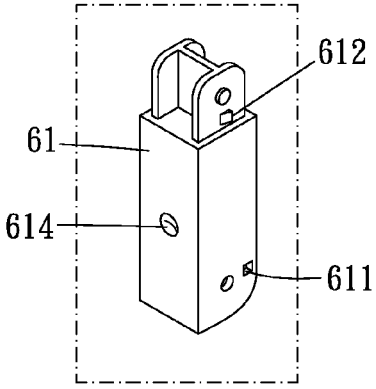
FIG. 6A is a stereogram of a rod segment of the present invention.
Figure 6:
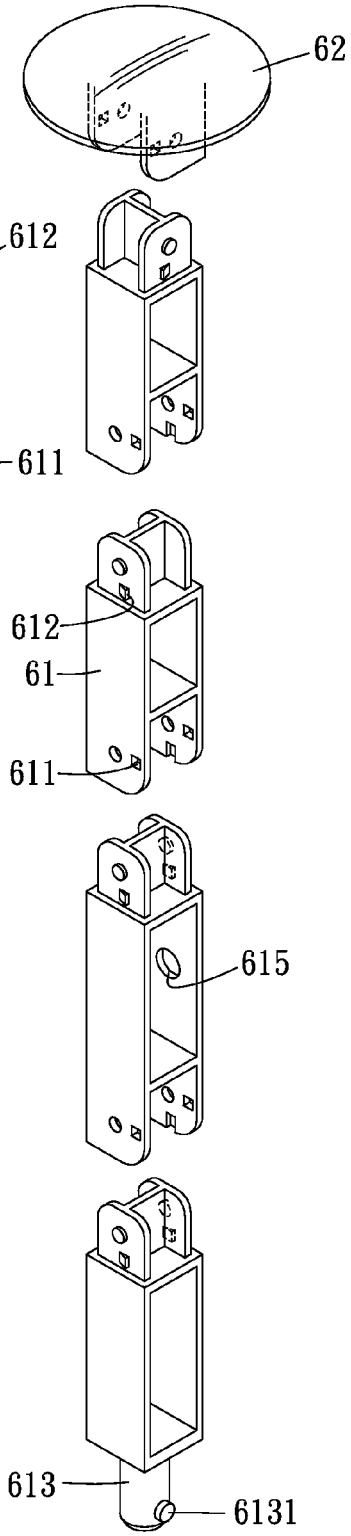
FIG. 6 is breakdown drawing of the pressing rod of the present invention.

Furthermore, as shown in FIG. 6A, one of the rod segments 61 has a recess 614 on an outer surface thereof, and an abutting piece 212 is arranged on an inner wall of the receiving room 21. The abutting piece 212 is a rolling-ball and is pushed by an elastic element. When the pressing rod 60 is folded and is received in the receiving room 21, the abutting piece 212 tends to abut against the recess 614 due to the elastic element so that the pressing rod 60 is restricted from being separated from the receiving room 21. However, the pressing rod 60 is stilled able to be removed when the elastic force by the elastic element is resisted by the force exerted by a user.

Besides, a square bump 213 is formed on the bottom of the receiving room 21. The through hole 211 penetrates through the square bump 213. The square bump 213 has a shape corresponding to a space enclosed by the rod segments 61 when the pressing rod 60 is folded. Thus, when the pressing rod 60 is folded and received in the receiving room 21, the square bump 213 is surrounded by the rod segments 61 to restrict the pressing rod 60. Furthermore, a positioning hole 615 is formed on a face of one of the rod segment 61, and a restriction pin 214 is formed on the bottom of the receiving room 21. The restriction pin 214 positionally corresponds to the positioning hole 615 to be inserted into the positioning hole 615 in order to restrict the pressing rod 60.

A garbage can is also provided in the present invention. The garbage can includes the garbage can lid previously mentioned and a can 70. The main body 10 is set around the opening of the can 70. When the pressing rod 60 is straight rod-shaped, the pressing rod 60 is able to connect with the pressing pad 40 in order to push the pressing pad 40 downward into the can 70.

Figure 1:
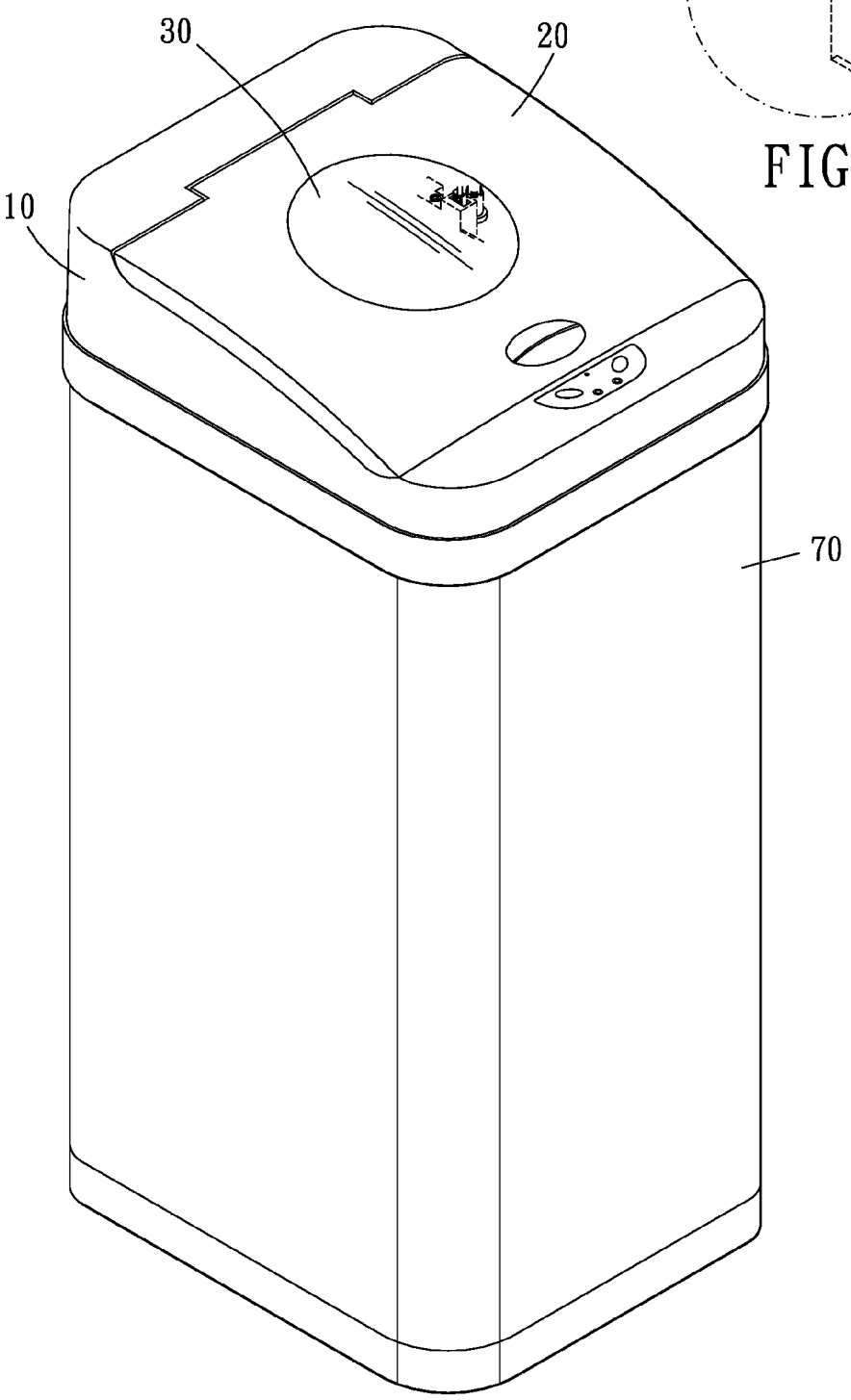
FIG. 1 is a stereogram of the present invention.

In a normal state, as shown in FIG. 1, the top lid 30 closes the receiving room, and the pressing rod is folded and received in the receiving room. By the switch or the sensor of the main body 10, a user can open the pivoting lid 20 to throw garbage into the can 70. Similarly, the pivoting lid 20 is closed again by the switch or the sensor of the main body 10.

Figure 2:
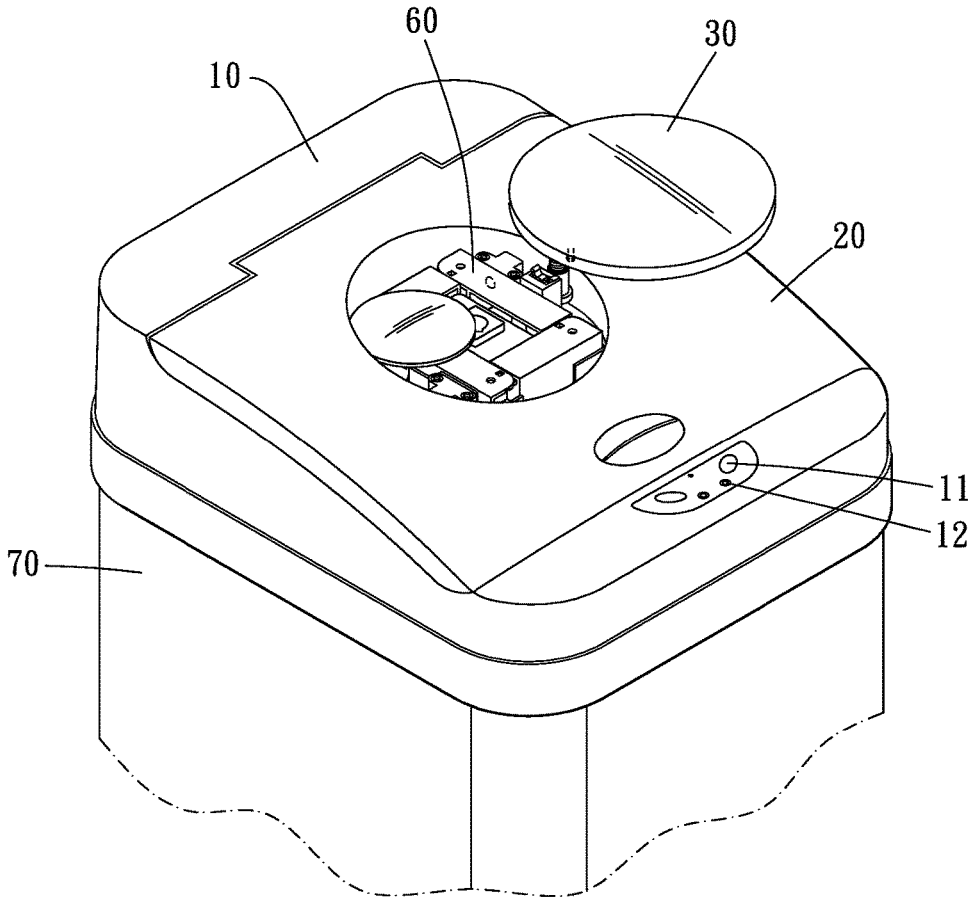
FIG. 2 is a stereogram showing a top lid being opened of the present invention.
Figure 3:
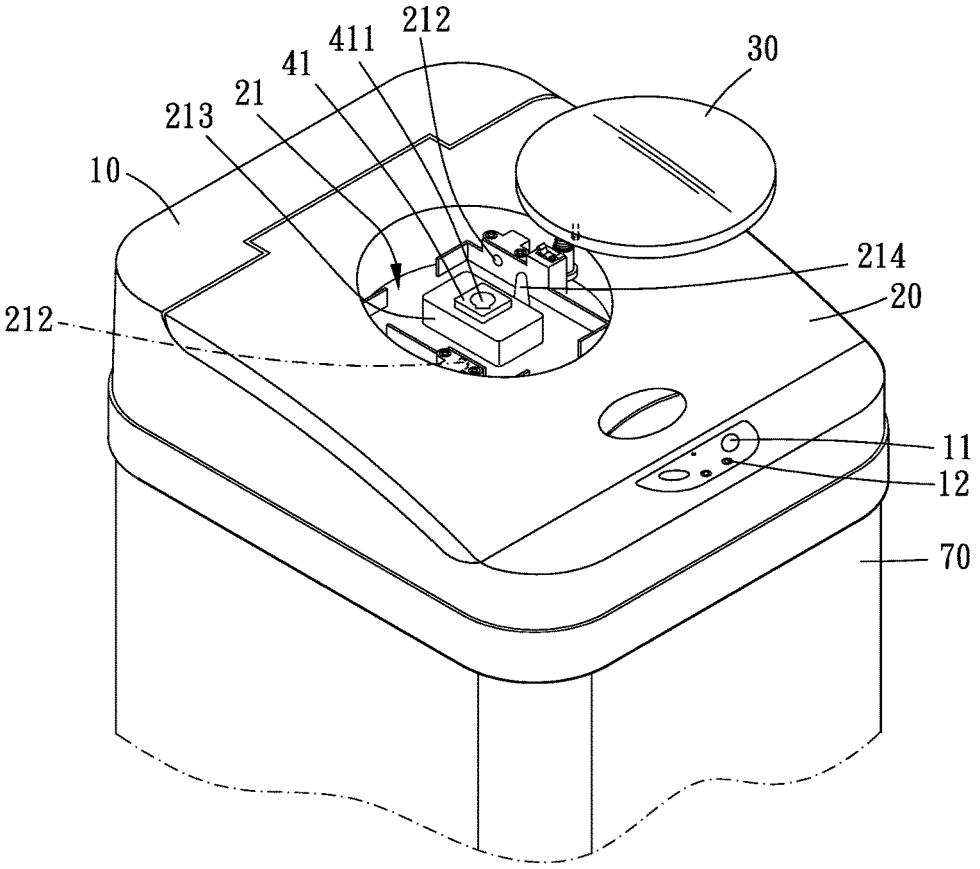
FIG. 3 is a stereogram of the present invention when a pressing rod is taken out.
Figure 4:
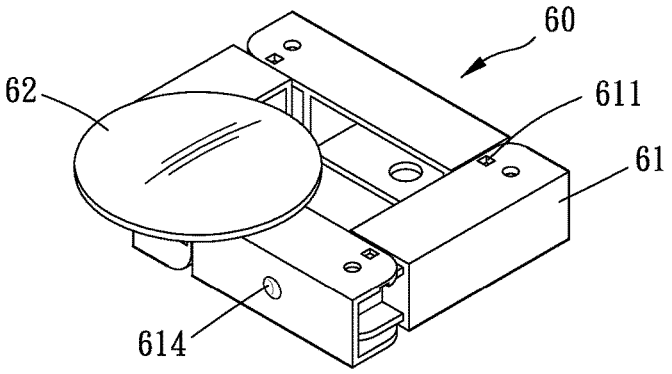
FIG. 4 is a stereogram of the present invention when the pressing rod is folded.
Figure 5:
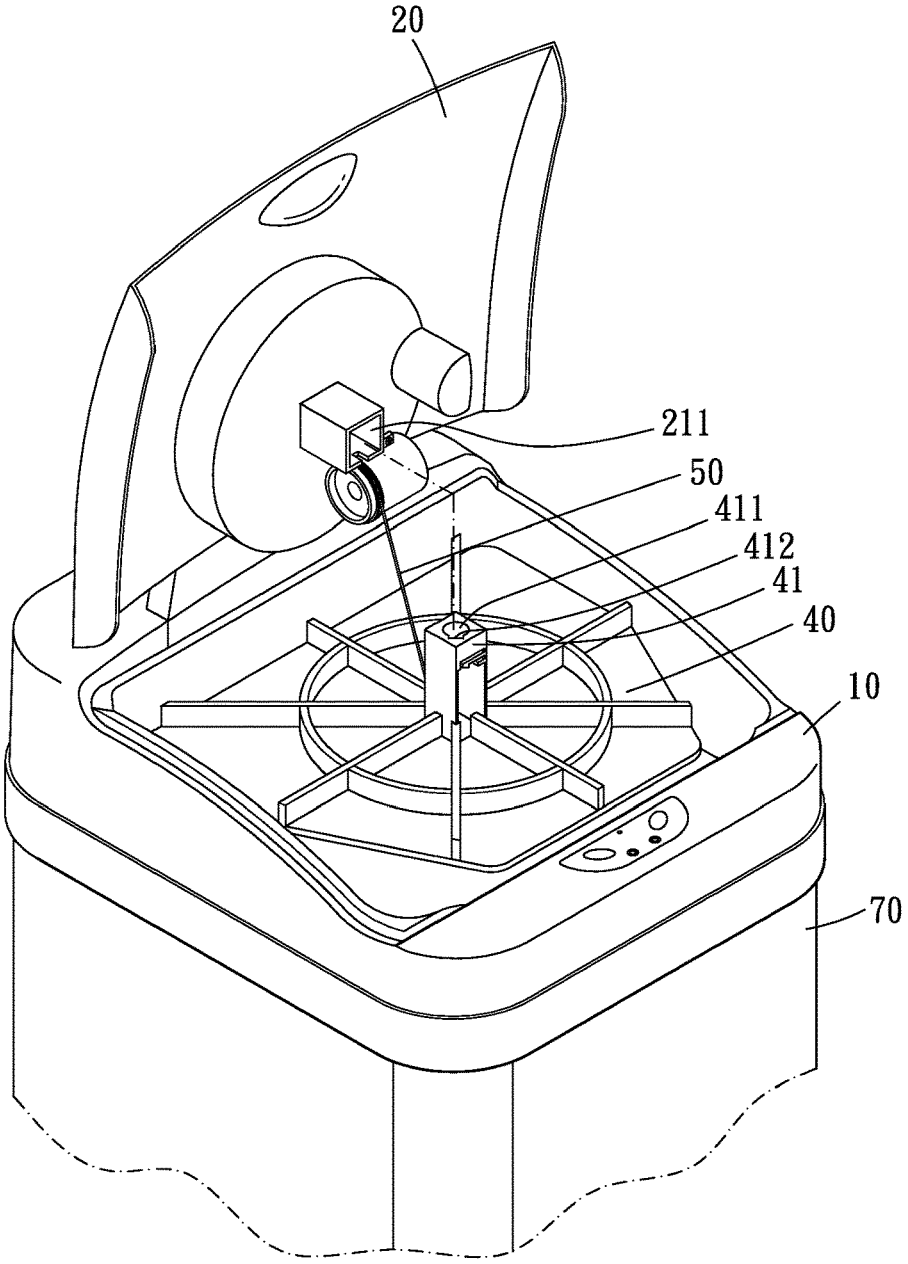
FIG. 5 is a stereogram of the present invention when a pivoting lid is opened.
Figure 7:
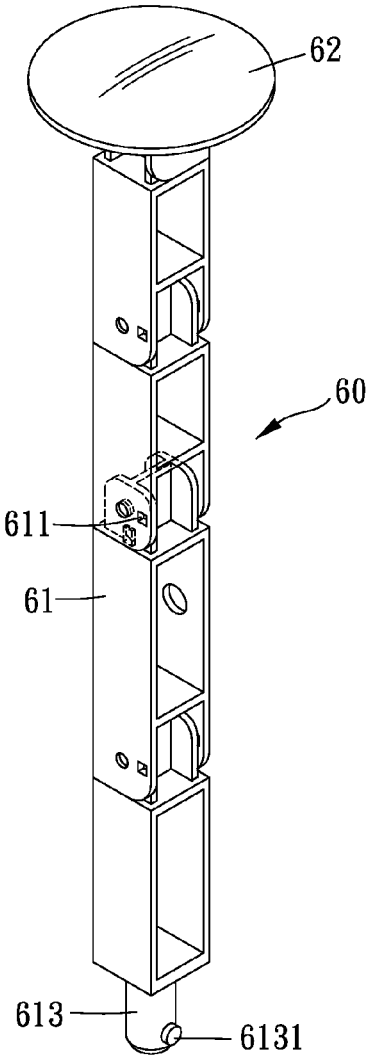
FIG. 7 is a stereogram of the present invention when the pressing rod is straight.
Figure 8:
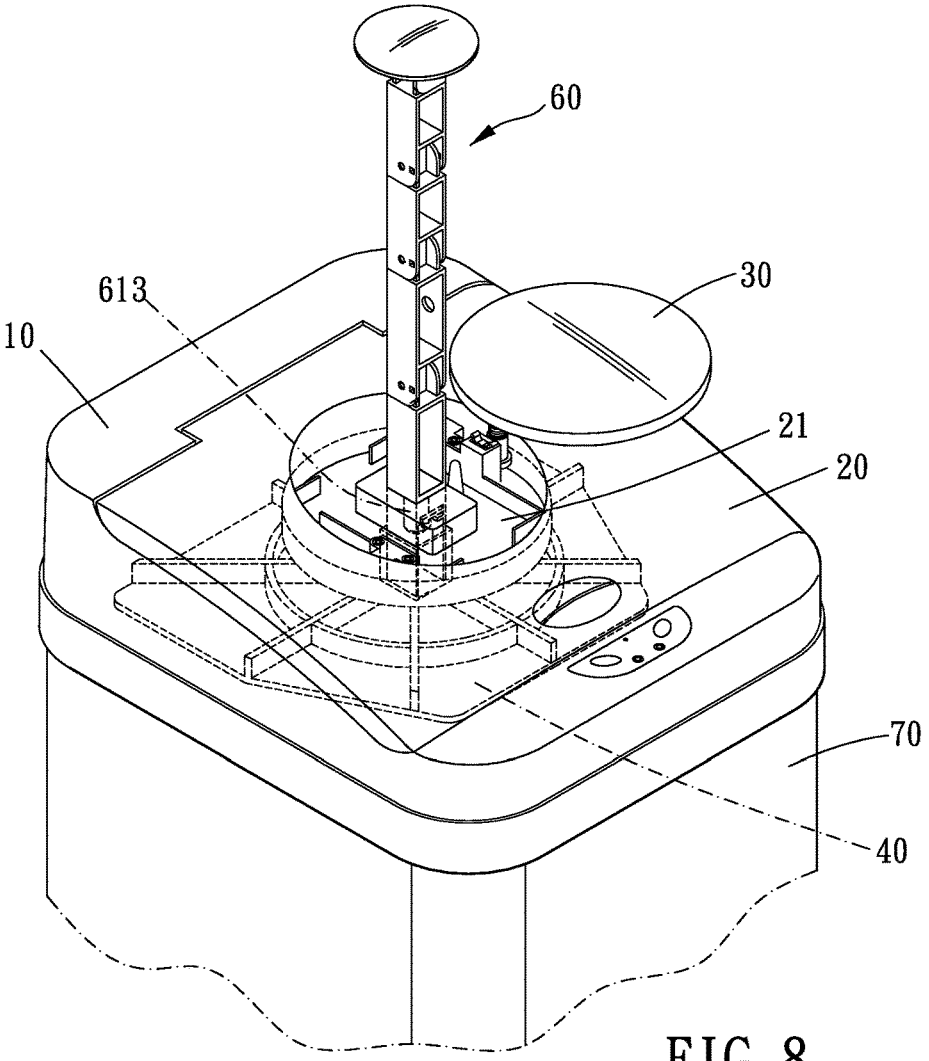
FIG. 8 is a stereogram of the present invention when the pressing rod is connected with a pressing pad.
Figure 9:
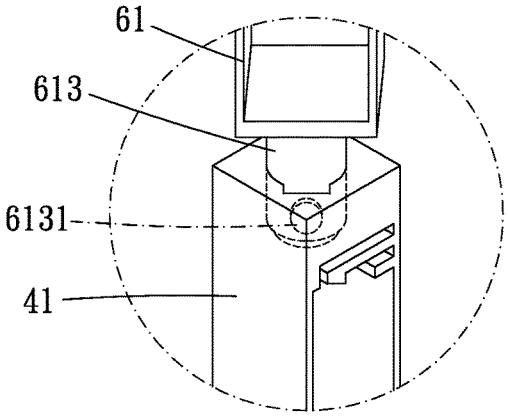
FIGS. 9 and 10 are illustrations showing steps of connection between the pressing rod and the pressing pad.
Figure 10:
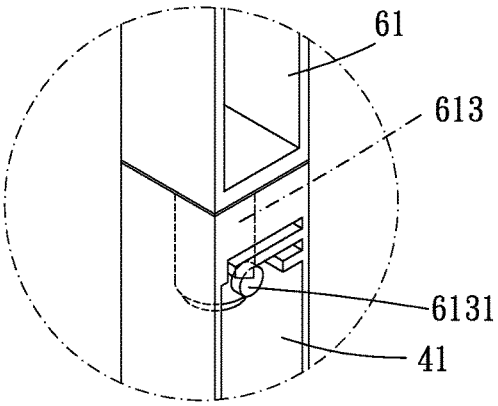
Figure 11:
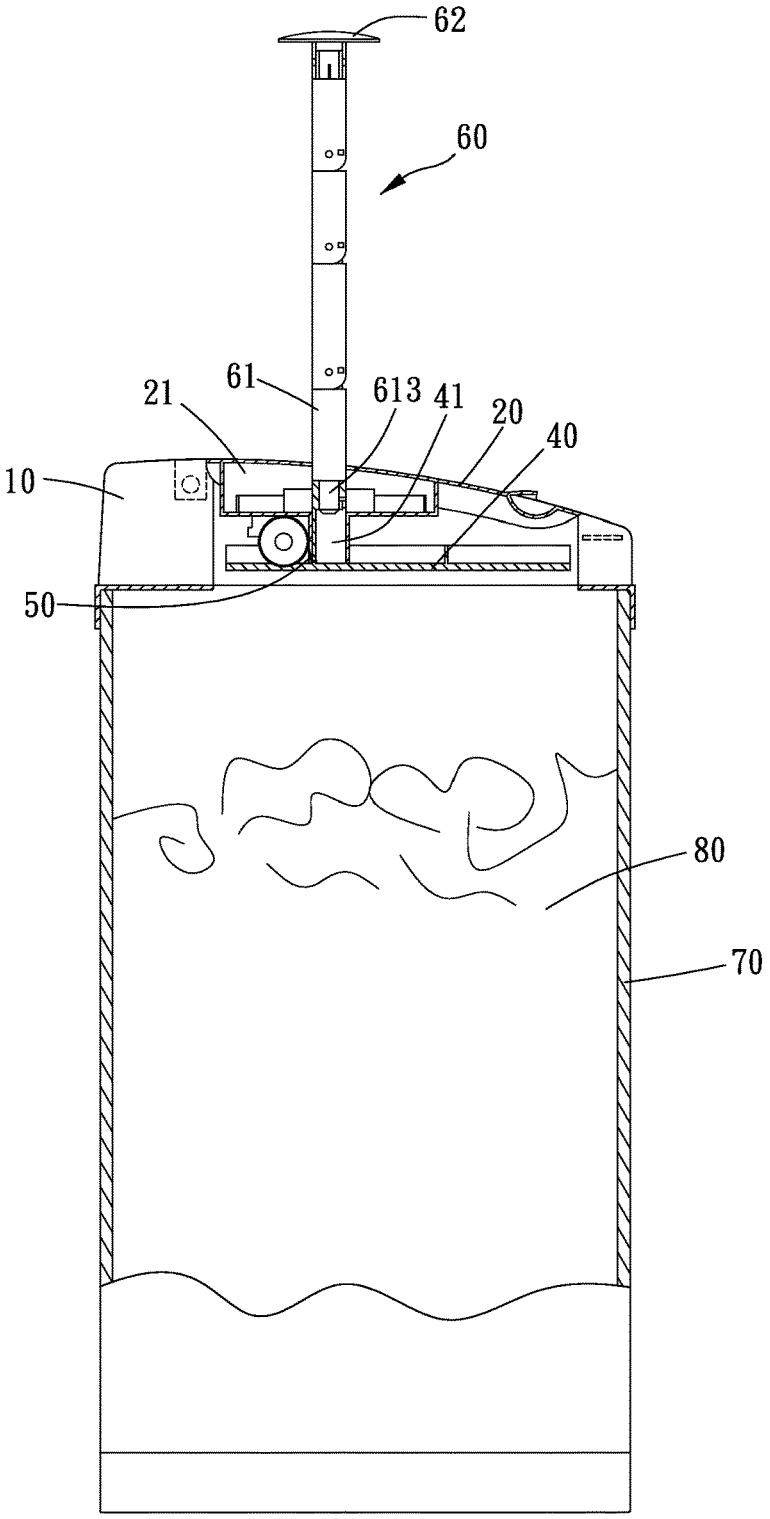
FIG. 11 is a lateral view of the present invention.

When the garbage in the can is to be compressed, a user can compress the garbage by the following steps. As shown in FIGS. 2 and 3, the positioning pin is separated from the clipping element by pressing the top lid 30, and the top lid 30 is moved away from the receiving room 21 by pivoting it. Thereafter, the pressing rod 60 is taken out from the receiving room 21 and is pivoted to be straight rod-shaped as shown in FIG. 7. And then, as shown in FIG. 9, the engaging portion 613 is inserted into the guiding hole, and the sliding piece 6131 is slidably disposed in the guiding groove. Due to the restriction by the sliding piece and the guiding groove, the pressing rod 60 is unable to rotate with respect to the connecting portion 41. In addition, an angle between the lateral face of the pressing rod 60 and the lateral face of the connecting portion 41 is proximately 45 degrees. That is, an angle between the lateral face of the pressing rod 60 and the inner wall of the through hole is proximately 45 degrees. Thus, the pressing rod 60 is unable to pass through the through hole completely. When the engaging portion 613 further inserts into the guiding hole, the sliding piece 6131 leaves the guiding groove to enter a breach. Thereby, the sliding piece 6131 is not restricted by the guiding groove so that the pressing rod 60 is able to rotate with respect to the connecting portion 41 for 45 degrees in order to allow the pressing rod 60 pass through the through hole, as shown in FIGS. 8, 10, and 11.

Figure 12:
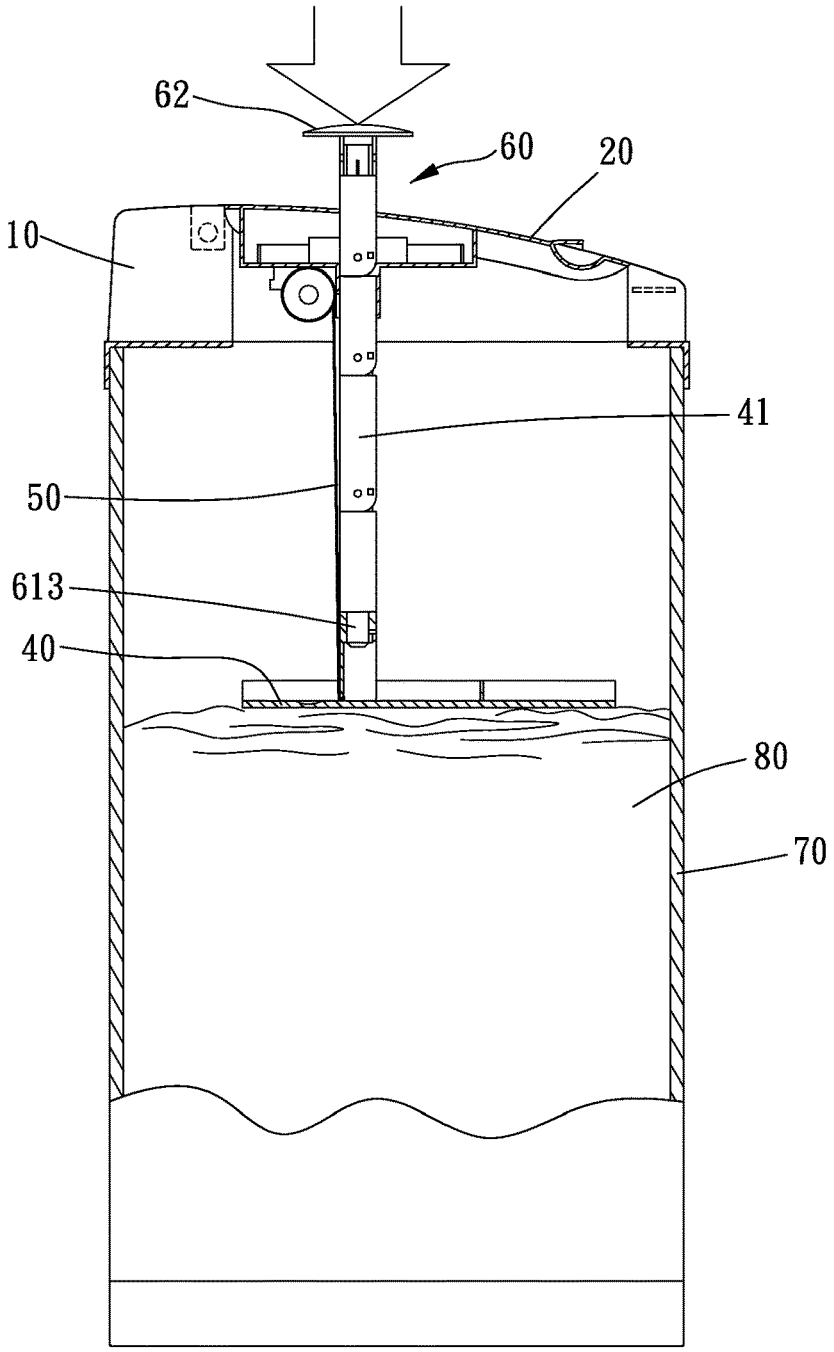
FIG. 12 is a lateral view of the present invention when compressing garbage.

The pressing element 62 is further pushed downward by a user to push the pressing pad 40 downward, as shown in FIG. 12. Thereby, the garbage 80 in the can 70 can be compressed by the pressing pad 40 to release more space. When the operation of compressing garbage is finished, the user can release the pressing rod 60, and the pressing pad 40 is moved upward to the original position by the restoring element. And then, the user can rotate the pressing rod 60 for 45 degrees to allow the sliding piece enter the guiding groove so that the pressing rod 60 can be removed. The pressing rod 60 is able to be folded to be the rectangular frame and to be placed into the receiving room 21. Thereafter, the top lid is moved back to close the receiving room.

In conclusion, the present invention is adapted for compressing the garbage in the can without opening the garbage can lid. In addition, the pressing rod is foldable and receivable. Besides, the compressing mechanism is simple and easy to use.

What is claimed is:

1. A garbage can lid having garbage compressing mechanism, including:

a main body, adapted for being disposed on a can above a can opening of the can, the main body being formed with an opening;

a pivoting lid, pivotally disposed on the main body to selectively close the opening, the pivoting lid being formed with a through hole;

a pressing pad, arranged below the pivoting lid, a face of the pressing pad facing the pivoting lid having a connecting portion which positionally corresponds to the through hole;

a restoring element, associating the pivoting lid and the pressing pad so that the pressing pad tends to move toward the pivoting lid;

a pressing rod, the pressing rod having a pressing element and an engaging portion at two opposite ends thereof, the engaging portion being able to be inserted through the through hole of the pivoting lid to be detachably engaged with the connecting portion of the pressing pad so as to push the pressing pad downward;

wherein a top of the pivoting lid is recessedly formed with a receiving room, the through hole is formed on a bottom of the receiving room, a top lid is disposed on the pivoting lid to selectively cover the receiving room, the pressing rod includes four rod segments which are pivotally linked one by one so that the pressing rod is foldable to be received in the receiving room, a restriction structure is arranged between any two adjacent rod segments, the restriction structure includes a restriction notch and a restriction protrusion which has an inclined top face, the restriction notch is formed on one of the two adjacent rod segments, the restriction protrusion is formed on an outer surface of the other one of the two adjacent rod segments, the restriction protrusion is covered by its adjacent rod segment and the restriction notch and the restriction protrusion are staggered from each other when the two adjacent rod segments are aligned, the restriction protrusion is received in the restriction notch to prohibit the two adjacent rod segments from pivoting with respect to each other when the two adjacent rod segments are substantially perpendicular to each other, the pressing element is pivotally disposed on a free end of the most distal rod segment, the restriction structures allow the four rod segments to pivot to form a rectangular frame, the rectangular fame is able to be received in the receiving room.

2. The garbage can lid of claim 1, wherein the connecting portion of the pressing pad is substantially rectangular column-shaped and is formed with a guiding hole which is tube-shaped, an inner wall of the guiding hole is formed with a guiding groove extending axially, the guiding groove positionally corresponds to one corner of the connecting portion, the through hole of the pivoting lid is tube-shaped and has a rectangular cross-section, the connecting portion is able to be slidably received in the through hole, the engaging portion of the pressing rod is substantially cylinder-shaped, the engaging portion is formed with a sliding piece on an outer surface thereof, the sliding piece is slidably received in the guiding groove when the engaging portion is inserted into the guiding hole.

3. The garbage can lid of claim 2, wherein each rod segment is rectangular column-shaped to correspond to the through hole of the pivoting lid, the sliding piece positionally corresponds to one side face of the rod segment.

4. The garbage can lid of claim 1, wherein an inner wall of the receiving room is arranged with an abutting element, one of the rod segments is formed with a recess on an outer surface thereof, the abutting element is pushed by an elastic element to abut against the recess when the pressing rod is folded and is received in the receiving room, the pressing rod is unable to be removed from the receiving room freely when the abutting element abuts against the recess.

5. The garbage can lid of claim 1, wherein a square bump is formed on the bottom of the receiving room, the square bump has a shape corresponding to a space enclosed by the rod segments when the pressing rod is folded.

6. The garbage can lid of claim 1, wherein a restriction structure is arranged between the pressing element and the rod segment which is connected with the pressing element.

7. The garbage can lid of claim 1, wherein the pressing element is pivotable around a first pivot axis with respect to the rod segment which is connected to the pressing element, any two adjacent rod segments are pivotable with respect to each other around a pivot axis perpendicular to the first pivot axis.

8. The garbage can lid of claim 1, wherein the top face of each restriction protrusion is rectangular and has an edge connected with an outer surface of the rod segment, the restriction protrusion has three lateral faces including two triangular lateral faces and a rectangular lateral face.

9. The garbage can lid of claim 1, wherein the restoring element is an elastic rope.

10. A garbage can, including the garbage can lid of claim 1, further including the can, the main body being arranged above the can opening of the can, the pressing rod being able to push the pressing pad downward into an interior of the can.

* * * * *